US011168383B2

(12) United States Patent
Mann et al.

(10) Patent No.: US 11,168,383 B2
(45) Date of Patent: Nov. 9, 2021

(54) ALUMINUM-BASED ALLOY

(71) Applicant: OBSHCHESTVO S OGRANICHENNOY OTVETSTVENNOST'YU "OBEDINENNAYA KOMPANIYA RUSAL INZHENERNO-TEKHNOLOGICHESKIY TSENTRY", Krasnoyarsk (RU)

(72) Inventors: Viktor Khrist'yanovich Mann, Krasnoyarsk (RU); Aleksandr Yur'evich Krokhin, Krasnoyarsk (RU); Aleksandr Nikolaevich Alabin, Krasnoyarsk (RU); Aleksandr Petrovich Khromov, Krasnoyarsk (RU)

(73) Assignee: Obshchestvo S Ogranichennoy Otvetstvennost'Yu "Obedinennaya Kompaniya Rusal Inzhenerno-Tekhnologicheskiy Tsentr", Krasnoyarsk (RU)

( * ) Notice: Subject to any disclaimer, the term of this patent is extended or adjusted under 35 U.S.C. 154(b) by 139 days.

(21) Appl. No.: 16/724,114

(22) Filed: Dec. 20, 2019

(65) Prior Publication Data

US 2020/0140976 A1 May 7, 2020

Related U.S. Application Data

(63) Continuation of application No. PCT/RU2017/000439, filed on Jun. 21, 2017.

(51) Int. Cl.
*C22C 21/00* (2006.01)

(52) U.S. Cl.
CPC ..... *C22C 21/00* (2013.01)

(58) Field of Classification Search
None
See application file for complete search history.

(56) References Cited

U.S. PATENT DOCUMENTS

| | | | |
|---|---|---|---|
| 3,989,548 | A | 11/1976 | Morris |
| 6,531,004 | B1 | 3/2003 | Lenczowski et al. |

FOREIGN PATENT DOCUMENTS

| | | | |
|---|---|---|---|
| EP | 2787094 | A1 | 10/2014 |
| RU | 2570264 | C2 | 12/2015 |
| WO | 2016144836 | A1 | 9/2016 |

OTHER PUBLICATIONS

International Search Report and Written Opinion of the International Searching Authority dated Mar. 15, 2018, 8 pages.

*Primary Examiner* — Adam Krupicka
(74) *Attorney, Agent, or Firm* — Baker & McKenzie LLP

(57) ABSTRACT

The invention relates to the field of metallurgy of aluminum-based materials and can be used to produce articles (including welded structures) operated in corrosive environments (humid atmosphere, fresh or sea water, and other corrosive environments) and under high-load conditions, including at elevated and cryogenic temperatures. A new, inexpensive, high-strength aluminum alloy is provided with high physical and mechanical properties, performance, and corrosion resistance, in particular, high mechanical properties after annealing (tensile strength of at least 400 MPa, yield point of at least 300 MPa, and relative elongation of at least 15%) and high performance in deformation processing; wherein high performance in deformation processing is provided due to the presence of eutectic Fe-containing alloy phases, accompanied by increased mechanical properties due to the formation of compact particles of eutectic phases and secondary separation of the Zr-containing phase with the $L1_2$ crystal lattice. The aluminum alloy contains zirconium, iron, manganese, chromium, scandium, and optionally magne- (Continued)

sium. It also additionally comprises at least one eutectics forming element selected from the group consisting of silicon, cerium and calcium, wherein the structure of the alloy is an aluminum matrix containing silicon and optionally magnesium, secondary separations of $Al_3(Zr,X)$ phases with the $L1_2$ lattice and a size of not more than 20 nm, wherein X is Ti and/or Sc, secondary separations of $Al_6Mn$ and $Al_7Cr$, and eutectic phases containing iron and at least one element from the group consisting of calcium and cerium with an average particle size of not more than 1 μm, with the following phase ratio, wt. %:

Secondary separations of $Al_3(Zr,Sc)$: 0.5-1.0;

Secondary separations of $Al_6Mn$ and $Al_7Cr$: 2.0-3.0;

Eutectic particles containing iron and at least one element from the group consisting of calcium and silicon: 0.5-6.0;

Aluminum matrix: the remainder.

3 Claims, 1 Drawing Sheet

ALUMINUM-BASED ALLOY

CROSS-REFERENCE TO RELATED APPLICATIONS

This application is a continuation of and claims priority to PCT Application No. PCT/RU/000439, filed on Jun. 21, 2017, titled "Aluminium-Based Alloy," which is incorporated by reference in its entirety for all purposes.

FIELD OF THE INVENTION

The invention relates to the field of metallurgy of aluminum-based materials and can be used to produce articles (including welded structures) operated in corrosive environments (humid atmosphere, fresh or sea water, and other corrosive environments) and under high-load conditions, including at elevated and cryogenic temperatures. The alloy material can be produced in the form of rolled products (plates, sheets, rolled sheet materials), pressed profiles and pipes, forged products, other wrought semifinished articles, as well as powders, flakes, pellets, etc., with subsequent printing of the finished articles. The proposed alloy is intended for application primarily in transportation unit elements operable under load, such as aircrafts, hulls of motorboats and other ships, upper decks, skin panels for automobile bodies, tanks for automobile and railway transport, including for transporting chemically active substances, for application in the food industry, etc.

BACKGROUND

Because of their high corrosion resistance, weldability, high relative elongation values, and capability to operate at cryogenic temperatures, 5xxx wrought alloys of the Al—Mg system are widely applied in articles operating in corrosive environments. In particular, they are intended for use in sea and river water (waterborne transport, pipelines, etc.), and tanks for transporting liquefied gases and chemically active liquids. The main drawback of 5xxx alloys is the low annealed strength of wrought semifinished articles. For example, the yield point of 5083 alloys after annealing typically does not exceed 150 MPa (Promyshlennye Alyuminievye Splavy (Industrial Aluminum Alloys): Reference Book. S. G. Alieva, M. B. Altman, S. M. Ambartsumyan, et al. Moscow: Metallurgiya, 1984).

One way to increase the annealed strength of 5xxx alloys is additional doping with transition metals, of which Zr is the most popular, along with the less commonly used Hf, V, Er, and several others. An essential feature of such alloys in this case, as opposed to other known 5083 alloys of the Al—Mg system, is the presence of elements that form dispersoids, in particular, with the $L1_2$ lattice. The aggregate strengthening effect in this case is achieved by hard solution strengthening, first of all, by a hard aluminum solution with magnesium, and the presence of various secondary phases of secondary separations in the structure which form in the course of homogenizing (heterogenizing) annealing.

Thus, a material developed by Alcoa is known (patent RU 2431692). The alloy contains (wt. %): 5.1-6.5% magnesium, 0.4-1.2% manganese, 0.45-1.5% zinc, up to 0.2% zirconium, up to 0.3% chromium, up to 0.2% titanium, up to 0.5% iron, up to 0.4% silicon, 0.002-0.25% copper, up to 0.01% calcium, up to 0.01% beryllium, at least one element from the group consisting of boron and carbon, each up to 0.06%; at least one element from the group consisting of bismuth, lead, tin, each up to 0.1%, scandium, silver, lithium, each up to 0.5%, vanadium, cerium, yttrium, each up to 0.25%; at least one element from the group consisting of nickel and cobalt, each up to 0.25%, aluminum, and the remainder being unavoidable impurities. One of the drawbacks of this alloy is its relatively poor general strength, which limits its application in some cases. The presence of many small additives reduces the production rates, negatively affecting the productivity of foundry machines, while high magnesium content results in reduced performance and corrosion resistance.

A strengthening effect much greater than that of 5083 alloy is produced with simultaneously present scandium and zirconium additives. In this case, the effect is obtained due to the much more abundant formation of secondary separations (with a typical size of 5-20 nm) that are resistant to high-temperature heating during deformation processing and subsequent annealing of the wrought semifinished articles, ensuring greater strength. Thus, a material based on the Al—Mg system is known, doped with simultaneously added zirconium and scandium. In particular, FSUE CRISM Prometey has proposed a material known as 1575-1 alloy, disclosed in patent RU 2268319. The alloy is stronger than 5083 and 1565 alloys. The proposed material contains (wt. %): 5.5-6.5% magnesium, 0.10-0.20% scandium, 0.5-1.0% manganese, 0.10-0.25% chromium, 0.05-0.20% zirconium, 0.02-0.15% titanium, 0.1-1.0% zinc, 0.003-0.015% boron, 0.0002-0.005% beryllium, and the remainder being aluminum. The drawbacks of this material include a high magnesium content, which negatively affects performance in deformation processing and leads to reduced corrosion resistance in certain cases if the $\beta$-$Al_8Mg_5$ phase is present in the final structure.

Another material is known, disclosed in U.S. Pat. No. 6,139,653 by Kaiser Aluminum. The alloy based on the Al—Mg—Sc system additionally comprises elements selected from the group consisting of Hf, Mn, Zr, Cu, and Zn, more specifically (wt. %): 1.0-8.0% Mg, 0.05-0.6% Sc, as well as 0.05-0.20% Hf and/or 0.05-0.20% Zr, 0.5-2.0% Cu and/or 0.5-2.0% Zn. In certain embodiments, the material may further contain 0.1-0.8 wt. % Mn. The drawbacks of this material include relatively poor strength at the lower end of the magnesium content range, while magnesium content at the upper end results in low corrosion resistance and low performance in deformation processing. Attaining a high level of properties requires controlling the ratio of the sizes of particles formed by such elements as Sc, Hf, Mn, and Zr.

A material by the Aluminum Company of America is known, disclosed in U.S. Pat. No. 5,624,632. The aluminum-based alloy contains (wt. %) 3-7% magnesium, 0.05-0.2% zirconium, 0.2-1.2% manganese, up to 0.15% silicon, and about 0.05-0.5% of elements forming secondary separations selected from the group consisting of: Sc, Er, Y, Cd, Ho, Hf, and the remainder being aluminum, accidental elements and impurities.

The chosen prototype was the technical solution disclosed in U.S. Pat. No. 6,531,004 by Eads Deutschland Gmbh, where a weldable, corrosion-resistant material strengthened by Al—Zr—Sc ternary phase was proposed. The alloy contains (wt. %) the following main elements: 5-6% magnesium, 0.05-0.15% zirconium, 0.05-0.12% manganese, 0.01-0.2% titanium, 0.05-0.5% total scandium, terbium, and optionally at least one additional element selected from the group consisting of a number of lanthanides, in which scandium and terbium are present as mandatory elements, and at least one element selected from the group consisting of 0.1-0.2% copper and 0.1-0.4% zinc, and the remainder being aluminum and unavoidable impurities of not more than 0.1% silicon. The drawbacks of this material include the presence of rare and expensive elements. Furthermore, this material may be insufficiently resistant to high-temperature heating during process heating.

The main problem common to all of the above-mentioned alloys is poor performance in deformation processing due to substantial strengthening of the cast ingot upon homogenizing (heterogenizing) annealing.

DISCLOSURE OF THE INVENTION

The present invention provides a new, inexpensive, high-strength aluminum alloy with high physical and mechanical properties, performance, and corrosion resistance, in particular, high mechanical properties after annealing (tensile strength of at least 400 MPa, yield point of at least 300 MPa, and relative elongation of at least 15%), and high performance in deformation processing.

The technical result of the invention is the solution of the posed problem, providing high performance in deformation processing due to the presence of eutectic Fe-containing alloy phases, accompanied by increased mechanical properties due to the formation of compact particles of eutectic phases and secondary separation of the Zr-containing phase with the $L1_2$ crystal lattice.

The posed problem is solved and said technical result is achieved by proposing an aluminum alloy that contains zirconium, iron, manganese, chromium, scandium, and optionally magnesium, wherein the alloy additionally comprises at least one eutectics forming element selected from the group consisting of silicon, cerium and calcium, with the following component ratio, wt. %:

Zirconium 0.10 to 0.50, iron 0.10 to 0.30, manganese 0.40 to 1.5, chromium 0.15 to 0.6, scandium 0.09 to 0.25, and titanium 0.02 to 0.10; at least one element selected from the group consisting of silicon 0.10 to 0.50, cerium 0.10 to 5.0, and calcium 0.10 to 2.0; and optionally magnesium 2.0 to 5.2; the remainder being aluminum and unavoidable impurities, wherein the structure of the alloy is an aluminum matrix containing silicon and optionally magnesium, secondary separations of $Al_3(Zr,X)$ phases with the $L1_2$ lattice and a size of not more than 20 nm, wherein X is Ti and/or Sc, secondary separations of $Al_6Mn$ and $Al_7Cr$, and eutectic phases containing iron and at least one element from the group consisting of calcium and cerium with an average particle size of not more than 1 am, with the following phase ratio, wt. %:

Secondary separations of $Al_3(Zr,Sc)$: 0.5-1.0;

Secondary separations of $Al_6Mn$ and $Al_7Cr$: 2.0-3.0;

Eutectic phases containing iron and at least one element from the group consisting of calcium and silicon: 0.5-6.0;

Aluminum matrix: the remainder.

In certain embodiments, the distance between the particles of $Al_3(Zr,X)$ phases of the secondary separations is not more than 50 nm. The zirconium, scandium, and titanium content of the alloy satisfies the following condition: Zr+Sc*2+Ti>0.4 wt. %.

SUMMARY OF THE INVENTION

It was found that, to ensure high mechanical properties, including as-annealed properties, the structure of the aluminum alloy should comprise an aluminum solution maximally doped with magnesium and a maximum number of secondary separation particles, in particular, phases of $Al_6Mn$ having an average size of up to 200 nm, $Al_7Cr$ having an average size of up to 50 nm, and $Al_3(Zr,X)$ particles, where element X is Ti and/or Sc, with the $L1_2$ lattice having an average size of up to 10 nm and an average interparticle distance of not more than 50 nm.

The increased strength effect in this case is provided by the combined favorable impact of hard solution strengthening of the aluminum solution due to magnesium and due to secondary phases containing manganese, chromium, zirconium, scandium, and titanium, resistant to high temperature heating. Further additional doping of the alloy with silicon and/or germanium reduces the solubility of zirconium, scandium and titanium in the aluminum solution, increasing the number of particles of secondary separations with a size of up to 10 nm and thus increasing strengthening efficiency.

The justification of the claimed amounts of doping components ensuring the target structure in the alloy is presented below.

Magnesium amounting to 4.0-5.2 wt. % is required to increase the overall level of mechanical properties due to hard solution strengthening. For magnesium content above 5.2 wt. %, the effect of this element will result in reduced performance in pressure processing (for example, ingot rolling), leading to a substantial deterioration of the product yield upon deformation. A content below 4 wt. % will not ensure the minimum required strength level.

Zirconium, scandium and titanium in amounts of 0.08-0.50 wt. %, 0.05-0.15 wt. % and 0.04-0.2 wt. %, respectively, are required to attain the target strength due to dispersion hardening with formation of secondary separations of $L1_2$ crystal lattice metastable phases of $Al_3Zr$ and/or $Al_3(Zr,X)$, where X is Ti or Sc. In general, zirconium, scandium and titanium redistribute between the aluminum matrix and secondary separations of the metastable phase of $Al_3Zr$ with the $L1_2$ lattice.

Zirconium concentrations in the alloy above 0.50 wt. % require elevated temperatures for melt preparation, which is not technically possible in certain cases in conditions of production melt preparation.

If using standard casting modes with zirconium content above 0.50 wt. %, primary crystals of the phase with the $D0_{23}$ lattice may form in the structure, which is not acceptable.

Zirconium, scandium and titanium content below the claimed level will not ensure the minimally required strength level due to an insufficient amount of secondary separations of metastable phases with the $L1_2$ lattice.

Chromium amounting to 0.1-0.4 wt. % is required to increase the overall level of the mechanical properties due to dispersion hardening with formation of the $Al_7Cr$ secondary phase.

For chromium content above the claimed level, the effect of this element will result in reduced performance in pressure processing (for example, ingot rolling), leading to a substantial deterioration of the product yield upon deformation. A content below 0.1 wt. % will not ensure the minimum required strength level.

Manganese amounting to 0.4-1.2 wt. % is required to increase the overall level of the mechanical properties due to dispersion hardening with formation of the $Al_6Mn$ secondary phase. For manganese content above the claimed level, the effect of this element will result in reduced performance in pressure processing (for example, ingot rolling) due to possible formation of the corresponding primary crystals, leading to a substantial deterioration of the product yield upon deformation. A content below 0.4 wt. % will not ensure the minimum required strength level.

Silicon in the claimed amounts is required, first of all, to accelerate the breakdown of the supersaturated hard aluminum solution. A similar effect by reducing the solubility of elements forming secondary separations with the $L1_2$ lattice upon annealing (in particular, zirconium, scandium, titanium). FIG. 1 schematically depicts this positive effect. Thus, on the one hand, for a silicon-containing alloy, the breakdown during homogenization annealing (at constant temperature $T_{X1}$) occurs faster ($\tau_1<\tau_2$). On the other hand, for the same time interval ($\tau_2$), a similar ageing effect may be obtained in a silicon-containing alloy at a lower temperature ($T_1>T_2$).

Specific time intervals depend on the ratio of the doping elements.

EXAMPLES OF THE EMBODIMENTS

Figure 1:
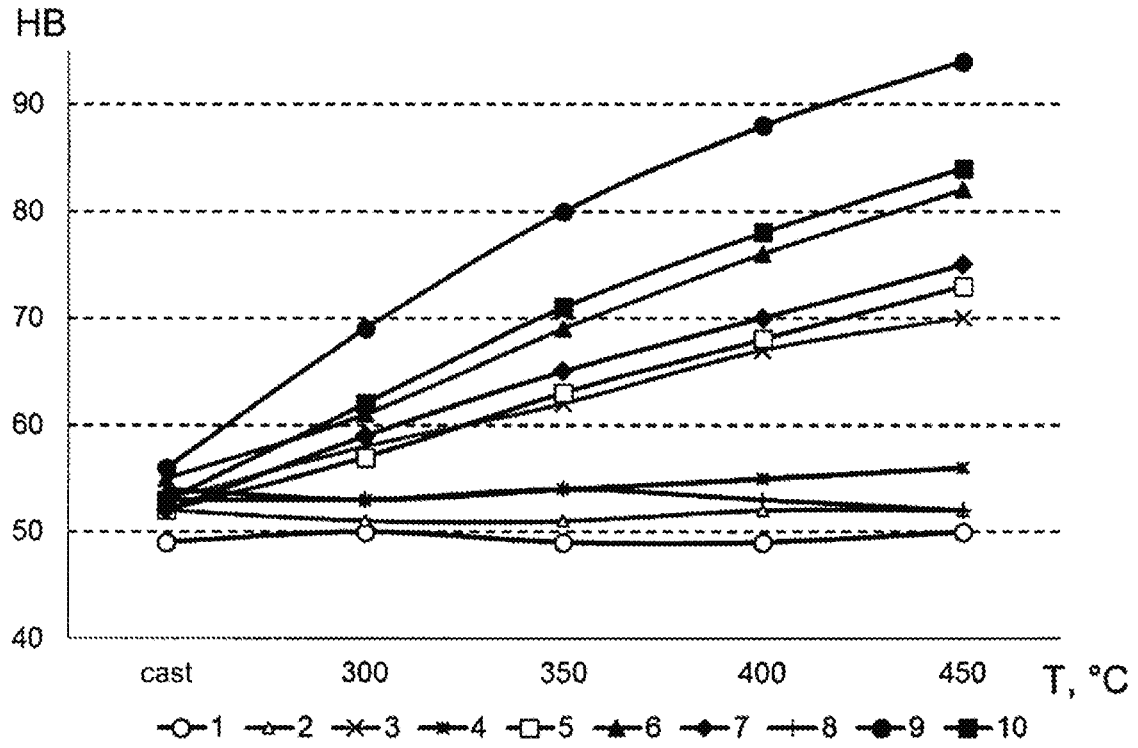
FIG. 1 is a plat of hardness versus the temperature, according to a specific embodiment of the disclosure.

The alloys were prepared in a resistance furnace in graphite crucibles using the following charging materials: aluminum (99.99), copper (99.9), magnesium (99.90) and double masters (Al-10Mn, Al-10Zr, Al-2Sc, Al-10Fe, Al-10Cr, Al-12Si). The number of phase components and the liquidus point ($T_1$) were calculated using the Thermo-Calc software (TTAL5 database). The melting and casting temperature was chosen based upon the condition $T_1$+50° C.

The claimed alloy compositions were prepared using two methods: ingot technology and powder technology. The ingots were produced by gravity die casting in a metal mold and semi-continuous casting in a graphite crystallizer with cooling rates in the 20 and 50 K/sec crystallization range, respectively. The powders were produced by spraying in a nitrogen atmosphere. Depending on the powder particle size, the cooling rate was 10,000 K/sec and higher.

Ingot deformation was performed on a laboratory rolling mill and horizontal press with an initial blank temperature of 450° C. Extrusion was performed on a horizontal press with a maximum pressing force of 1,000 tons.

The chemical composition was determined on an ARL4460 spectrometer.

The tensile strength was tested on turned specimens with a 50 mm gage length at a testing rate of 10 mm/min. Electrical conductivity was estimated using the eddy-current method. Hardness was determined by the Brinell method (load: 62.5 kgf, ball diameter: 2.5 mm, exposure time: 30 sec). All tests were performed at room temperature.

Example 1

Figure 2:
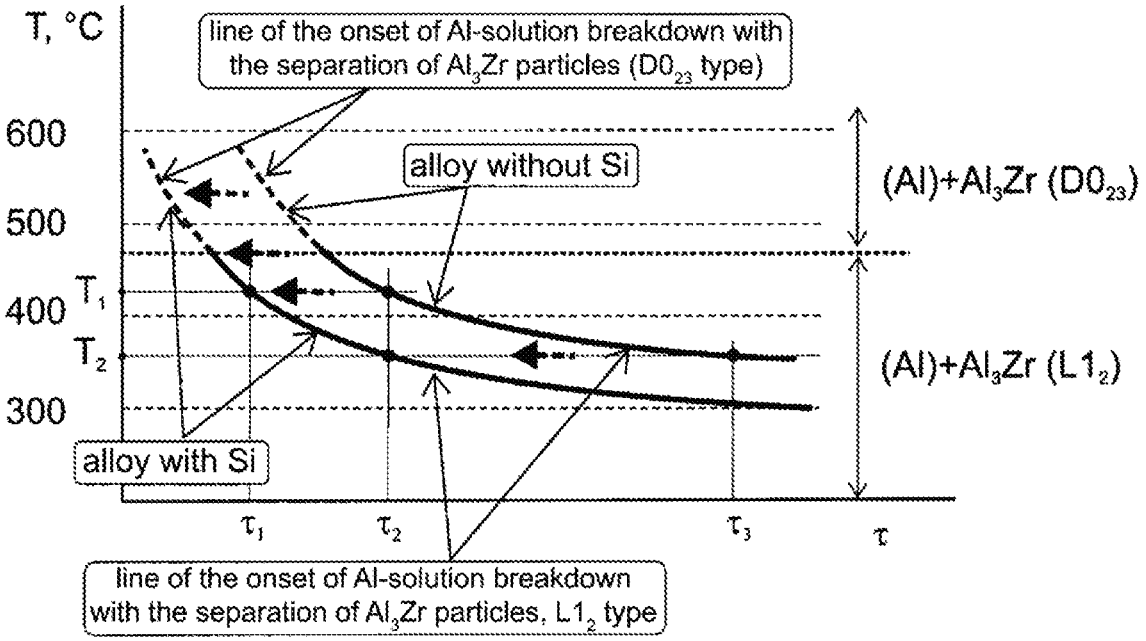
FIG. 2 is a plat of the temperature versus the time interval, according to a specific embodiment of the disclosure.

Ten experimental alloys were prepared in a laboratory setting as flat ingots. The chemical composition is given in Table 1. The as-cast alloys had the structure of an aluminum solution with iron- and cerium-containing eutectic phases in the background. No primary crystals of $D0_{23}$ type were found. Silicon influence on strengthening of the experimental alloys was evaluated by changes in hardness (HB) upon step-wise annealing starting with 300° C. to 450° C., with a step of 50° C. and a duration of up to 3 h at each step. The results of the hardness measurement are shown in FIG. 2

TABLE 1

Chemical Composition of the Experimental Alloys

| Alloy | Chemical Composition, wt. % | | | | | | | |
|---|---|---|---|---|---|---|---|---|
| No. | Zr | Fe | Mn | Cr | Sc | Ce | Si | Zr + 2*Sc |
| 1 | 0 | 0.2 | 0.51 | 0.53 | 0 | 0.52 | 0 | 0 |
| 2 | 0.19 | 0.19 | 0.51 | 0.51 | 0 | 0.51 | 0 | 0.19 |
| 3 | 0.2 | 0.2 | 0.5 | 0.53 | 0 | 0.52 | 0.14 | 0.2 |
| 4 | 0 | 0.21 | 0.5 | 0.52 | 0 | 0.51 | 0.14 | 0 |
| 5 | 0.21 | 0.21 | 0.5 | 0.52 | 0.11 | 0.52 | 0 | 0.43 |
| 6 | 0.2 | 0.21 | 0.51 | 0.52 | 0.1 | 0.53 | 0.14 | 0.40 |
| 7 | 0.3 | 0.21 | 0.51 | 0.52 | 0.05 | 0.53 | 0 | 0.40 |
| 8 | 0 | 0.21 | 0.51 | 0.52 | 0.1 | 0.53 | 0 | 0.2 |
| 9 | 0.6 | 0.21 | 0.51 | 0.52 | 0.1 | 0.53 | 0.10 | 0.8 |
| 10 | 0.6 | 0.21 | 0.51 | 0.52 | 0.1 | 0.53 | 0 | 0.8 |

An analysis of the obtained results demonstrates that significant strengthening (i.e., a change in hardness by more than 20 HB) is observed in alloys having the sum of Zr+2*Sc>0.4.

The presented results demonstrate that, other conditions being equal, greater strengthening, including the strengthening rate (by changes in hardness) is observed in silicon-containing alloys. An analysis of the fine structure of compositions 2 and 3 shows that the number of particles with the $L1_2$ structure in alloy 3 is at least 30% higher than in alloy 2 (starting already at 350° C.).

This influence of silicon can be explained by shifting the line of the onset of breakdown of hard aluminum solution supersaturated with zirconium and/or scandium in the presence of silicon to the left relative the line of the onset of breakdown of alloys without added silicon (FIG. 1).

The most preferred silicon concentration is 0.14 wt. %.

Example 2

Six experimental alloy compositions were prepared in a laboratory setting as 0.8 mm thick rolled sheets. The chemical composition is given in Table 2.

TABLE 2

Chemical Composition of the Experimental Alloys

| Alloy | Chemical Composition, wt. % | | | | | | | | |
|---|---|---|---|---|---|---|---|---|---|
| No. | Zr | Fe | Mn | Cr | Sc | Ce | Mg | Si | Note |
| 11 | 0.14 | 0.17 | 0.43 | 0.18 | 0.12 | — | 3.9 | 0.14 | |
| 12 | 0.14 | 0.17 | 0.40 | 0.17 | 0.11 | — | 5.1 | 0.14 | Cracks |
| 13 | 0.14 | 0.18 | 0.41 | 0.20 | 0.10 | — | 6.1 | 0.14 | Cracks |
| 14 | 0.15 | 0.19 | 0.43 | 0.18 | 0.12 | 0.21 | 3.8 | 0.14 | |
| 15 | 0.14 | 0.18 | 0.42 | 0.17 | 0.11 | 0.20 | 5.1 | 0.14 | |
| 16 | 0.14 | 0.17 | 0.41 | 0.19 | 0.10 | 0.20 | 6.1 | 0.14 | Cracks |

Under deformation processing, alloys No. 12, 13 and 16 had cracks at the edges upon rolling. A comparison of alloys No. 12 and 15, having comparably similar concentrations of the doping elements, apart from cerium content, shows that alloy No. 15 produced no cracks upon rolling, which is explained by the presence of the eutectic phase promoting a more homogeneous deformation and, as a result, the absence of cracks upon sheet rolling. However, with a higher magnesium concentration, even the presence of the eutectic component does not exclude crack formation.

The results of mechanical tensile tests for alloys No. 11, 14 and 15 are given in Table 3. The tests were performed after annealing the sheets at 350° C. for 3 hours.

TABLE 3

| Mechanical Tensile Properties | | | |
|---|---|---|---|
| Alloy No. | Tensile Strength, MPa | σ0.2 MPa | δ, % |
| 11 | 374 | 204 | 17 |
| 14 | 388 | 208 | 17 |
| 15 | 430 | 298 | 13 |

Unlike alloy No. 15, alloys No. 11 and 14 do not meet the requirements to mechanical properties. The composition of alloy 15 is the most preferred for production of rolled sheet materials.

Example 3

In a laboratory setting, alloy No. 15 (Table 2) and the alloy with a chemical composition given in Table 4 were used to prepare samples in the form of ingots and powder for four cooling rates, primarily to evaluate the sizes of structural components of eutectic phases and the presence/absence of primary crystals.

TABLE 4

| Chemical Composition of the Experimental Alloys | | | | | | | | |
|---|---|---|---|---|---|---|---|---|
| Alloy | Chemical Composition, wt. % | | | | | | | |
| No. | Zr | Fe | Mn | Cr | Sc | Ce | Mg | Si |
| 17 | 0.5 | 0.14 | 0.40 | 0.17 | 0.11 | 5.0 | 3.1 | 0.14 |

| Cooling Rate, K/sec | | Alloy No. 15 | Alloy No. 17 |
|---|---|---|---|
| Less than 1 | Average size of Fe-containing phases, μm | More than 10 | – |
| | Presence of $D0_{23}$ | + | – |
| 10 | Average size of Fe-containing phases, μm | 3 | – |
| | Presence of $D0_{23}$ | None | – |
| 100 | Average size of Fe-containing phases, μm | 1.5 | – |
| | Presence of $D0_{23}$ | None | – |
| 100,000 | Average size of Fe-containing phases, μm | – | Less than 1 |
| | Presence of $D0_{23}$ | None | None |

What is claimed is:

1. An aluminum alloy containing zirconium, iron, manganese, chromium, scandium, and optionally magnesium, characterized in that the alloy additionally comprises at least one eutectics forming element selected from the group consisting of silicon, cerium and calcium, with the following component ratio, wt. %:

Zirconium: 0.10 to 0.50;
Iron: 0.10 to 0.30;
Manganese: 0.40 to 1.5;
Chromium: 0.15 to 0.6;
Scandium: 0.09 to 0.25;
Titanium: 0.02 to 0.10;
At least one element
selected from the group consisting of:
Silicon: 0.10 to 0.50;
Cerium: 0.10 to 5.0;
Calcium: 0.10 to 2.0;
Optionally magnesium: 2.0 to 5.2;
Aluminum and unavoidable impurities: the remainder;
wherein the structure of the alloy is an aluminum matrix containing silicon and optionally magnesium, secondary separations of $Al_3(Zr,X)$ phases with the $L1_2$ lattice and a size of not more than 20 nm, wherein X is Ti and/or Sc, secondary separations of $Al_6Mn$ and $Al_7Cr$, and eutectic phases containing iron and at least one element from the group consisting of calcium and cerium with an average particle size of not more than 1 μm, with the following phase ratio, wt. %:
Secondary separations of $Al_3(Zr,Sc)$: 0.5-1.0;
Secondary separations of $Al_6Mn$ and $Al_7Cr$: 2.0-3.0;
Eutectic phases containing iron and at least one element from the group consisting of calcium and silicon: 0.5-6.0;
Aluminum matrix: the remainder.

2. The alloy of claim 1, characterized in that the distance between the particles of $Al_3(Zr,X)$ phases of the secondary separations is not more than 50 nm.

3. The alloy of claim 1, characterized in that the zirconium, scandium, and titanium content of the alloy satisfies the following condition: Zr+Sc*2+Ti>0.4 wt. %.

* * * * *